US009044055B2

(12) United States Patent
Hehenberger

(10) Patent No.: US 9,044,055 B2
(45) **Date of Patent: *Jun. 2, 2015**

(54) GARMENT WITH A RETROREFLECTIVE AND ELECTROLUMINESCENT ARTICLE

(75) Inventor: Rodney K. Hehenberger, Lake Elmo, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 508 days.

This patent is subject to a terminal disclaimer.

(21) Appl. No.: 13/202,839

(22) PCT Filed: Mar. 3, 2010

(86) PCT No.: PCT/US2010/025994

§ 371 (c)(1),
(2), (4) Date: Aug. 23, 2011

(87) PCT Pub. No.: WO2010/104706

PCT Pub. Date: Sep. 16, 2010

(65) Prior Publication Data

US 2011/0305006 A1 Dec. 15, 2011

Related U.S. Application Data

(60) Provisional application No. 61/159,553, filed on Mar. 12, 2009.

(51) Int. Cl.
*F21V 21/08* (2006.01)
*A41D 31/00* (2006.01)
(Continued)

(52) U.S. Cl.
CPC ..... *A41D 31/0094* (2013.01); *F21V 33/0008* (2013.01); *F21Y 2105/006* (2013.01); *A41D 13/01* (2013.01)

(58) Field of Classification Search
CPC ..... A41D 31/0094; A41D 31/0088; A41D 13/01; F21Y 2105/006; F21V 33/0008; F21W 2121/06; G09F 2013/225
USPC ..... 362/103, 107, 108, 84, 34
See application file for complete search history.

(56) References Cited

U.S. PATENT DOCUMENTS 3,758,192 A 9/1973 Bingham
4,664,966 A * 5/1987 Bailey et al. ..... 428/203
(Continued)

FOREIGN PATENT DOCUMENTS

CA 2487264 11/2004
DE 20313630 U1 9/2003
(Continued)

OTHER PUBLICATIONS

M 96 10 334 and M 97 00 908 DE Taste Sample Sheet Folder 13 of 0/10/1997, *Retro Reflecting Films for Speedometer Glass Lenses of the Type 1, 2, 3.*
(Continued)

*Primary Examiner* — Jong-Suk (James) Lee
*Assistant Examiner* — James Endo
(74) *Attorney, Agent, or Firm* — Nicole J. Einerson

(57) ABSTRACT

A garment (30) with a retroreflective and electroluminescent article (35) includes one or more electroluminescent structures (36), which may in some embodiments be discontinuous from each other. In some embodiments, the electroluminescent structures can be electrically connected with conductors (34) including conductive adhesive. The article further includes one or more retroreflective structures (39) disposed at least partially in the light path capable of being emitted by one or more of the electroluminescent structures. The article can be disposed on a support (33), such as a garment shell. The present disclosure also includes methods for making such garments.

22 Claims, 5 Drawing Sheets

(51) Int. Cl.

| | |
|---|---|
| ***A41D 13/01*** | (2006.01) |
| *F21V 33/00* | (2006.01) |
| *F21Y 105/00* | (2006.01) |

(56) References Cited

U.S. PATENT DOCUMENTS

| | | | | |
|---|---|---|---|---|
| 4,684,353 | A | 8/1987 | deSouza | |
| 4,983,436 | A | 1/1991 | Bailey | |
| D314,673 | S | 2/1991 | Legare | |
| 4,999,936 | A | 3/1991 | Calamia | |
| 5,237,448 | A | 8/1993 | Spencer | |
| 5,272,562 | A | 12/1993 | Coderre | |
| 5,315,491 | A | 5/1994 | Spencer | |
| 5,503,906 | A * | 4/1996 | Olsen | 428/32.71 |
| 5,567,040 | A | 10/1996 | Tabanera | |
| 5,570,945 | A | 11/1996 | Chien | |
| 5,770,124 | A | 6/1998 | Marecki | |
| 5,856,029 | A | 1/1999 | Burrows | |
| 5,856,030 | A | 1/1999 | Burrows | |
| 5,980,976 | A | 11/1999 | Burrows | |
| 5,981,032 | A | 11/1999 | Smith | |
| 6,066,384 | A * | 5/2000 | Crandall | 428/143 |
| 6,086,213 | A | 7/2000 | Holce | |
| 6,142,643 | A * | 11/2000 | Araki et al. | 362/84 |
| 6,146,006 | A | 11/2000 | Cross | |
| 6,166,856 | A * | 12/2000 | Araki et al. | 359/627 |
| 6,261,633 | B1 | 7/2001 | Burrows | |
| D446,945 | S | 8/2001 | Jacobs | |
| 6,270,834 | B1 | 8/2001 | Burrows | |
| 6,271,631 | B1 * | 8/2001 | Burrows | 315/169.3 |
| 6,309,764 | B1 | 10/2001 | Burrows | |
| 6,551,726 | B1 | 4/2003 | Burrows | |
| 6,696,786 | B2 | 2/2004 | Burrows | |
| 6,717,361 | B2 | 4/2004 | Burrows | |
| 6,769,138 | B2 | 8/2004 | Golle | |
| 6,859,941 | B2 | 3/2005 | Koppes | |
| 6,898,018 | B2 * | 5/2005 | Minoura et al. | 359/627 |
| 6,931,665 | B2 | 8/2005 | Feduzi | |
| 6,964,493 | B1 | 11/2005 | Whitlock | |
| 6,974,610 | B1 | 12/2005 | Koppes | |
| 7,107,622 | B2 | 9/2006 | Feduzi | |
| 7,144,127 | B2 | 12/2006 | Golle | |
| 7,147,339 | B2 | 12/2006 | Golle | |
| 7,156,528 | B2 | 1/2007 | Weiss | |
| 7,220,011 | B2 | 5/2007 | Hurwitz | |
| 7,229,183 | B2 | 6/2007 | Golle | |
| 7,229,184 | B2 | 6/2007 | Golle | |
| 7,281,813 | B2 | 10/2007 | Golle | |
| D587,907 | S | 3/2009 | Vandenberg | |
| D587,908 | S | 3/2009 | Carlson | |
| D587,909 | S | 3/2009 | Carlson | |
| D594,663 | S | 6/2009 | Vandenberg | |
| D594,664 | S | 6/2009 | Otte | |
| 7,600,269 | B2 | 10/2009 | Feduzi | |
| D613,073 | S | 4/2010 | Hehenberger | |
| 8,015,620 | B2 | 9/2011 | Feduzi | |
| 2002/0141060 | A1 | 10/2002 | Lu | |
| 2003/0150043 | A1 * | 8/2003 | Koppes | 2/69 |
| 2005/0157390 | A1 | 7/2005 | Weiss | |
| 2006/0011287 | A1 | 1/2006 | Carlson | |
| 2006/0034064 | A1 | 2/2006 | Kanzler | |
| 2006/0044651 | A1 | 3/2006 | Mimura | |
| 2006/0092625 | A1 * | 5/2006 | McKowen | 362/108 |
| 2006/0143772 | A1 | 7/2006 | Feduzi | |
| 2006/0291194 | A1 * | 12/2006 | Golle et al. | 362/108 |
| 2007/0056077 | A1 * | 3/2007 | Feduzi et al. | 2/81 |
| 2008/0030856 | A1 * | 2/2008 | King | 359/536 |
| 2009/0021831 | A1 | 1/2009 | Bacon, Jr. | |
| 2009/0070967 | A1 * | 3/2009 | Gonzalez | 24/16 R |
| 2009/0097234 | A1 * | 4/2009 | von Malm | 362/103 |
| 2010/0177517 | A1 | 7/2010 | Foley | |
| 2010/0202143 | A1 | 8/2010 | Ruehlemann | |
| 2010/0231113 | A1 | 9/2010 | Hehenberger | |
| 2010/0232143 | A1 | 9/2010 | Burrows | |

FOREIGN PATENT DOCUMENTS

| | | | |
|---|---|---|---|
| DE | 202004011734 U | | 9/2003 |
| EP | 0166534 | | 1/1986 |
| EP | 0648436 | | 4/1995 |
| EP | 1084633 | | 3/2001 |
| EP | 0594089 | | 6/2001 |
| EP | 0896683 | | 6/2001 |
| EP | 1127984 | | 8/2001 |
| EP | 0759179 | | 11/2001 |
| EP | 1992240 | | 11/2008 |
| FR | 2896608 | | 1/2006 |
| GB | 1038469 | | 8/1966 |
| GB | 1424754 | | 2/1976 |
| GB | 2408915 | | 6/2005 |
| GB | 2466027 | | 6/2010 |
| JP | 2005-077445 | | 3/2005 |
| JP | 2005-077448 | | 3/2005 |
| JP | 2006-228455 | | 8/2006 |
| WO | WO 91/18374 | | 11/1991 |
| WO | WO 94/25666 | | 11/1994 |
| WO | WO 98/20279 | | 5/1998 |
| WO | WO 98/20375 | | 5/1998 |
| WO | WO 98/58281 | | 12/1998 |
| WO | WO 01/49941 | | 7/2001 |
| WO | WO 03/007740 | | 1/2003 |
| WO | WO 2004/100111 | | 11/2004 |
| WO | WO 2006/129246 | | 12/2006 |
| WO | WO 2007/065227 | | 6/2007 |
| WO | WO 2007/092152 | | 8/2007 |
| WO | WO 2008122920 | A2 * | 10/2008 |
| WO | WO 2008/142012 | | 11/2008 |

OTHER PUBLICATIONS

International Search Report PCT/US2010/025994 Nov. 5, 2010, 5 pgs.

* cited by examiner

GARMENT WITH A RETROREFLECTIVE AND ELECTROLUMINESCENT ARTICLE

CROSS REFERENCE TO RELATED APPLICATIONS

This is a national stage filing under 35 U.S.C. §371 of PCT Application No. PCT/US2010/025994, filed Mar. 3, 2010, which claims priority to U.S. Provisional Application No. 61/159,553, filed Mar. 12, 2009, the disclosure of which is incorporated herein by reference in its entirety.

FIELD OF DISCLOSURE

The present disclosure pertains to a garment including a support and at least two electroluminescent structures used in combination with one or more retroreflective structures disposed on the support.

BACKGROUND

Electroluminescent lighting is commonly used in applications requiring light weight and low power illumination, such as conspicuity garments. Electroluminescent lamps are typically made of a layer of phosphor disposed between two layers of electrodes where one electrode layer is transparent or translucent, allowing light to shine through it when the lamp is powered. When electroluminescent lamps are used for garments, they can provide a good source of light in dark environments to increase the visibility of individuals wearing the garments.

Retroreflective materials are also commonly used on a variety of garments, including vests, hats, shirts, jackets, footwear, and other garments. Retroreflective materials can be created in a variety of ways, including using a layer of glass beads, a reflective agent disposed under the beads and a binder. When incident light enters the bead, the bead focuses the light on the reflective agent. The reflective agent forces the light back through the bead so that it exits in a generally opposite direction of the incident light at about the same angle. This process of reflecting light back in the general direction of its source is commonly referred to as retroreflection. Retroreflective lighting is an excellent source of conspicuity in the dark when headlights or other incident light is reflected off of the retroreflective materials disposed on a garment.

Electroluminescent lighting and retroreflective materials can be disposed on or attached to garments through a variety of methods. There remains a need for garments that provide increased and/or improved conspicuity to their wearers under a variety of conditions and that can be easily and efficiently manufactured.

SUMMARY

In one aspect, the present disclosure is directed to a garment including a support and an electroluminescent and retroreflective article disposed on the support. The article includes at least two electroluminescent structures and a retroreflective structure. At least two electroluminescent structures include an electrode layer, a phosphor layer disposed over the electrode layer and a transparent electrode layer disposed over the phosphor layer. The retroreflective structure is disposed over the electroluminescent structure and at least partially in a path of light capable of being emitted by the electroluminescent structure. At least one connector electrically connects at least two of the electroluminescent structures, and at least two of the electroluminescent structures are discontinuous.

In another aspect, the present disclosure includes a garment including a support and an electroluminescent and retroreflective article disposed on the support. The article includes at least two electroluminescent structures and a retroreflective structure. At least two electroluminescent structures include an electrode layer, a phosphor layer disposed over the electrode layer and a transparent electrode layer disposed over the phosphor layer. The retroreflective structure is disposed over the electroluminescent structure and at least partially in a path of light capable of being emitted by the electroluminescent structure. At least one connector including conductive adhesive electrically connects at least two of the electroluminescent structures.

In a third aspect, the present disclosure includes a method for making a garment. The method includes providing an electroluminescent and retroreflective article, which includes an electroluminescent structure, a retroreflective structure disposed over the electroluminescent structure, and a removable carrier film disposed over the retroreflective structure. The electroluminescent structure includes an electrode layer, a phosphor layer disposed over the electrode layer and a transparent electrode layer disposed over the phosphor layer. The method further includes disposing the electroluminescent article on a support; and removing the carrier film from the article.

BRIEF DESCRIPTION OF THE DRAWINGS

The invention may be more completely understood in consideration of the following detailed description of various embodiments of the invention in connection with the accompanying drawing, in which.

The figures are not necessarily to scale. Like numbers used in the figures refer to like components. However, it will be understood that the use of a number to refer to a component in a given figure is not intended to limit the component in another figure labeled with the same number.

DETAILED DESCRIPTION

The present disclosure provides a garment with an electroluminescent article disposed on it that can result in improved conspicuity for the wearer in a variety of lighting conditions, including dawn, dusk and dark. In addition to the advantage of conspicuity, a garment consistent with the present disclosure can have increased flexibility and stretchability. This can result in increased comfort for the wearer. An electroluminescent article consistent with the present disclosure can be disposed on a greater variety of garments and supports, e.g., light weight flexible materials such as those used in tee shirts. A garment may also have improved durability for wear and washing.

Figure 1:
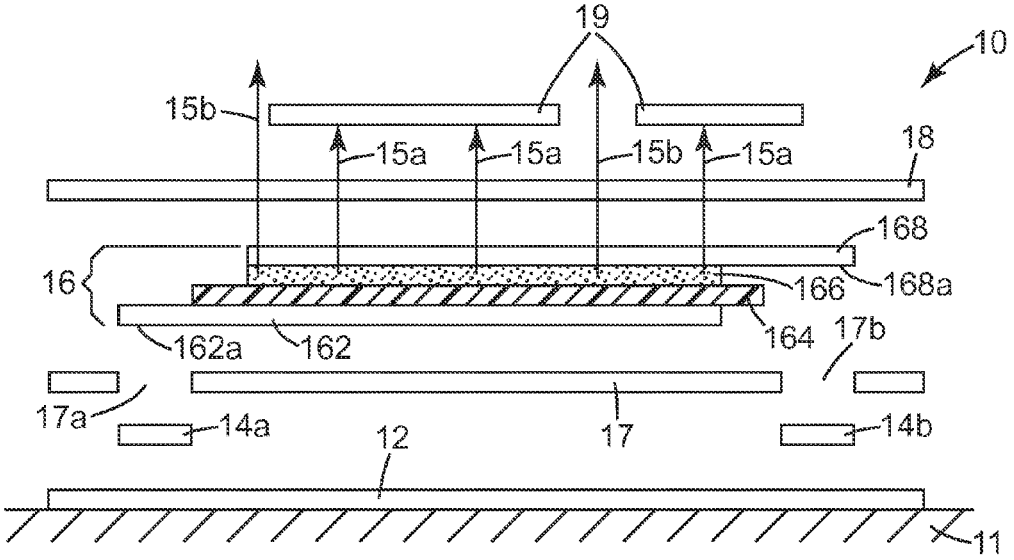
FIG. 1 shows an exploded cross-sectional view of an exemplary laminate reflective and electroluminescent article disposed on a support.

FIG. 1 shows an exploded cross sectional view of an exemplary laminate reflective and electroluminescent article 10 disposed on a support 11. For the purposes of the present disclosure, the term "laminate" shall mean that the structure is composed of layers of firmly attached materials and shall not be indicative of the process by which the structure is made or the layers are attached. The article 10 can be disposed on a variety of supports 11 including, but not limited to, cloth, plastic and other porous or nonporous materials. A support 11 can be the material used to make a garment (not shown) or can be an additional layer of material attached to a surface or other portion of a garment. Adhesive 12 can be used to secure the adjacent components of the electroluminescent article 10, such as one or more of conductors 14*a*, 14*b*, electroluminescent structure 16 and protective layer 17, to the support 11. Alternatively, the electroluminescent article 10 can be printed, or disposed on a support 11 by other appropriate methods. An optional protective layer 17 can be included between support 11 and electroluminescent structure 16.

Conductors 14*a*, 14*b* can be disposed between adhesive 12 and protective layer 17. Protective layer 17 can have openings 17*a* and 17*b*, which allow leads 162*a* and 168*a* of first electrode layer 162 and second electrode layer 168, respectively, to come into electrical contact with conductors 14*a* and 14*b*. Alternatively, conductors 14*a*, 14*b* can be disposed in any appropriate location, and other methods known to those of skill in the art can be used to electrically connect conductors 14*a* and 14*b* with electrode layers 162 and 168. If multiple electroluminescent structures are used, one or more conductive structures, such as one or more conductors 14*a*, 14*b* can electrically connect one or more electroluminescent structures to a power supply, in series or independently. Additionally, conductors 14*a*, 14*b* may electrically connect one or more electroluminescent structure to an inverter.

Conductors 14*a*, 14*b* can include conductive adhesive. Conductive adhesive can be made of materials such as polymeric materials, including polyester fibers (such as polyester terephthalate), or natural fibers, coated with conductive materials (such as one or more of copper, nickel and carbon). The fibers can be coated with a doped adhesive, such as acrylate adhesive, to provide conductive attachments. Conductors 18*a*, 18*b* can be made of commercially available conductive adhesives such as 3M™ CN 3190 Cu/Ni fabric tape, available from 3M Company. 3M™ CN 3190 Cu/Ni fabric tape includes anti-corrosion treated copper-nickel coated conductive polyester fabric and electrically conductive pressure-sensitive acrylic adhesive. Conductive adhesives can offer benefits such as flexibility and conformability, light weight and strength.

Alternatively, conductors 14*a*, 14*b* can include wires, conductive yarns, strips of conductive material such as copper, a bus bar, printed circuit conductors or other suitable conductors. While both conductors 14*a*, 14*b* are shown as disposed underneath electroluminescent structure 16 in FIG. 1, they can be disposed in other appropriate locations. One conductor (14*a*) must be electrically connected to electrode 162 and another conductor (14*b*) must be electrically connected to electrode 168. In embodiments including multiple electroluminescent structures 16, two or more conductors can be used to electrically connect the electroluminescent structures 16 to each other and to a power source. If conductors 14*a* and 14*b* are not insulated, additional insulation (not shown) may be provided as needed. The additional insulation may be in the form of one or more layers.

Referring further to FIG. 1, an exemplary electroluminescent structure 16 can include a first electrode layer 162, a dielectric layer 164, a phosphor layer 166 and a second electrode layer 168. Additional layers can be added or dielectric layer 164 can be removed. An exemplary electroluminescent structure can be made using a suitable unitary carrier, preferably capable of being deployed in gel form, such as a vinyl resin carrier, a urethane resin carrier (e.g., urethane acrylate) and other suitable materials. Exemplary materials suitable for use in the present disclosure are listed in U.S. Pat. Nos. 5,856,029, 5,856,030, 6,696,786, and 6,717,361. In some embodiments, the carrier can be UV curable and may include a catalyst. At least some layers or each layer can include the unitary carrier and some or all layers can also be doped with various additives. Such a carrier can be disposed on a wide variety of supports, including metals, plastics, and cloth fabrics. Alternately, any other appropriate carrier could be used. Layers 162, 164, 166, 168 can be deposited by coating, printing, stacking or any other appropriate method.

In one embodiment, the electroluminescent article can be at least partially, and, preferably, entirely monolithic. A monolithic structure can be created by suspending layers of the electroluminescent structure in a unitary common carrier. The layers can be disposed, for example, by printing them one on top of another. When all layers are disposed, the structure can be solidified, e.g., by curing, and the layers will become strata in a monolithic mass. Although in FIG. 1 the constituent components are shown as discrete layers and elements, all of the layers of the electroluminescent structure 16, such as the first electrode layer 162, dielectric layer 164, phosphor layer 166 and second electrode layer 168 can be part of a monolithic structure. In other exemplary embodiments, any two, three, four, or more adjacent layers could form a monolithic structure consistent with the present disclosure. Additionally, protective layers 17 and 18 can also be part of a monolithic structure.

Doping the various layers of the monolithic structure can be achieved by mixing appropriate amounts of dopants with any suitable carrier, as described above. Dopants and amounts can be, for example, similar to those discussed in U.S. Pat. Nos. 5,856,029, 5,856,030, 6,696,786, and 6,717,361, or can be determined by using other suitable methods. First electrode layer 162 can include the unitary carrier doped with an ingredient to make the suspension electrically conductive. For example, silver or carbon in particulate form can be used as a dopant. Alternatively, gold, zinc, aluminum, graphite, copper, any combination thereof or any other appropriate ingredient may be used. The thickness of first electrode layer 162 can be, for example, about 8 to 12 microns or any other serviceable thickness.

Dielectric layer 164 can include the unitary carrier doped with a dielectric such as barium-titanate powder or any other appropriate dielectric in particulate form. Dielectric layer 164 can be deposited in multiple layers to prevent the possibility of any pinholes in the layer 164. Dielectric layer 164 can have a thickness of about 15 to 35 microns, for example, or any other serviceable thickness.

Phosphor layer 166 can include the unitary carrier, such as vinyl gel resin, doped with electroluminescent grade encapsulated phosphor. An appropriate thickness for phosphor layer 166 can be 25 to 35 microns, or any other serviceable thickness. The color of light emitted by phosphor layer 166 is dependent on the choice of phosphor used in layer 166. A variety of colored dyes can be added to phosphor layer 166 to achieve a desired color of light, for example, blue, white, safety yellow or safety orange but those knowledgeable in the art will also note that adding colored pigments or dyes in other layers, e.g., protective layer 18, could also achieve a similar effect. For example, rhodamine can be added to phosphor layer 166 to achieve the appearance of white light when the electroluminescent structure 16 is energized. Additional admixtures can be combined with phosphor layer 166 to improve the performance of phosphor layer 166. Dielectric layer 164 preferably overlaps electrode layer 162 to prevent electrical contact between first electrode layer 162 and second electrode layer 168.

Second electrode layer 168 can include the unitary carrier doped with a suitable translucent or transparent electrical conductor to allow light to be emitted through second electrode layer 168. For example, the dopant for second electrode layer 168 can include indium-tin-oxide (ITO) in powder form or any other appropriate dopant. Second electrode layer 168 can have a thickness of about 5 microns or any other serviceable thickness.

Exemplary weights of dopants and methods for mixing each respective layer consistent with the present disclosure are described, for example, in U.S. Pat. No. 6,551,726.

An electroluminescent structure as illustrated in FIG. 1 is not limited solely to the four layers depicted. Any number of layers resulting in a functional electroluminescent structure can be used. For example, other layers can be disposed in electroluminescent structures 16 for aesthetic or protective purposes. Electroluminescent structures 16 can also be a variety of shapes depending on intended use and/or other considerations.

Layers 162, 164, 166, 168 can be disposed using a variety of methods including coating or printing, e.g., silk-screen printing. When layers are screen printed, they can be printed in a series of intermediate layers to achieve a desired overall combined thickness. Layers can be cured, e.g., by exposure to ionizing radiation, such as heat or UV light or by any other appropriate method known to those skilled in the art.

Alternatively, layers 162, 164, 166, 168 can be distinct. Layers 162, 164, 166, 168 can be deposited by coating, printing, stacking or any other appropriate method. A transparent protective layer 18 can be deposited, for example, printed, coated or laminated, over the electroluminescent structure 16 to protect and/or seal the structure. An additional protective layer 17 can be deposited between electrode layer 162 and adhesive 12. Protective layer 17 can alternatively be disposed between conductors 14*a*, 14*b* and adhesive 12. Protective layers 17 and 18 can be larger than other layers so as to seal the electroluminescent structure 16 creating an envelope. Protective layers 17, 18 can provide insulation for the electrodes 162, 168, and can be made of any material reasonably resistant to environmental conditions and can provide protection to electroluminescent structure 16 from moisture, abrasion, etc. Protective layers 17, 18 can also provide, for example, electrically insulating and/or environmentally protective capabilities. Protective layers 17, 18 can be made of any suitable materials, such as polymeric materials, including a vinyl resin carrier, a urethane resin carrier (e.g., urethane acrylate) and other suitable materials, e.g., those listed in U.S. Pat. Nos. 5,856,029, 5,856,030, 6,696,786 and other suitable materials known to those of ordinary skill in the art.

Electroluminescent structures 16 can be disposed so that they are discontinuous. For example, discontinuous electroluminescent structures may not have any components that connect one electroluminescent structure to an adjacent electroluminescent structure with the exception of conductors 14*a*, 14*b*. Additionally, discontinuous electroluminescent structures can allow a surface of the support to be exposed in a gap between at least two discontinuous electroluminescent structures 16.

Retroreflective structure 19 can be continuous or it can be discontinuous (including two or more disconnected retroreflective segments, which can be arranged in a variety of patterns). Retroreflective structures 19 can be deposited over the protective layer 18 or over the electroluminescent structure 16 or over any additional or alternative intervening layers by any suitable method. The retroreflective structure 19 is arranged such that a light-emitting side of the electroluminescent structures 16 faces toward the retroreflective structure 19, while a reflective side of the retroreflective structure 19 faces away from the electroluminescent structures 16.

Retroreflective structures 19 can be made from a variety of materials by any suitable method. In one embodiment, retroreflective structure 19 can be purchased, for example, in the form of a transfer film, and attached to the electroluminescent structures 16, with a light-emitting side of the electroluminescent structures 16 facing the retroreflective structure 19 and the reflective side of the retroreflective structure 19 facing away from the electroluminescent structures 16. Retroreflective structure 19 and electroluminescent structures 16 can be attached to each other using, for example, adhesive, such as a heat activatable adhesive, pressure sensitive adhesive, or any other suitable commercially available adhesives. Commercially available products that are particularly suitable for use in embodiments of the present disclosure include transfer films with discontinuous retroreflective segments removably disposed on a liner, which are available from 3M Company, St. Paul, Minn., under the Scotchlite™ brand. More particularly, 3M Scotchlite™ Reflective Materials, 5500 series Comfort Trim products may be used (e.g., 5510 and 5530 Segmented Trims). The retroreflective structures in such products typically include a layer of beads embedded in a binder and often also include heat activatable adhesive. Such transfer films trim can be heat laminated to electroluminescent structure 16 through heat press lamination methods and the liner can be removed to expose the discontinuous retroreflective structures 19. Alternatively, retroreflective structure 19 can be printed, coated, sewn or otherwise disposed on or attached to the electroluminescent structure 16.

In other embodiments, retroreflective structures can be made by methods such as those described in WO 94/25666. Glass beads can be embedded into a temporary carrier (bead carrier). Specularly reflective materials such as aluminum, silver, or cryolite can then be selectively vapor coated, screen printed, or otherwise disposed onto the exposed surface of the beads. A binder can be coated or otherwise disposed on the vapor coated reflective layer, and a heat activatable adhesive or another adhesion promoter can be provided. Optionally, one may include a release liner that can be adhered to the adhesive side to prevent adhesion during manufacturing or shipping or a fabric for alternative application for sewing the retroreflective segments on a garment. Prior to use on a garment, the bead carrier will be removed to expose the beads and allow retroreflection.

Retroreflective segments 19 can also be made by plotter cutting a desired image or shape into a commercially available retroreflective tape, such as 3M™ Scotchlite™ reflective transfer film, series 8700, or 3M™ Scotchlite™ reflective material 5807 series.

Figure 2:
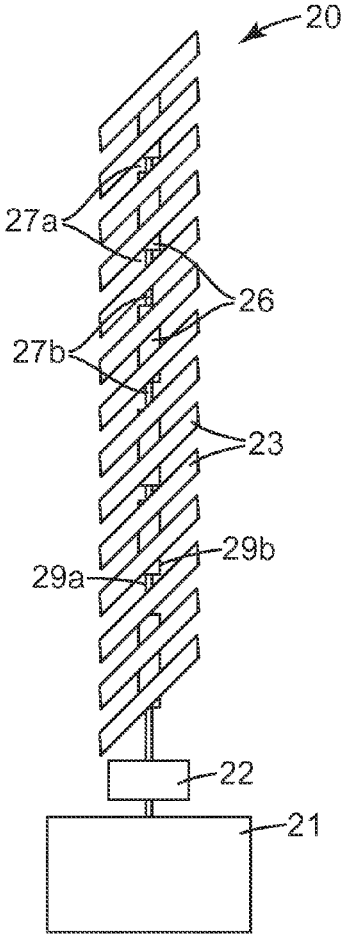
FIG. 2 shows a schematic diagram of an exemplary reflective and electroluminescent article connected to a power source.
Figure 3:
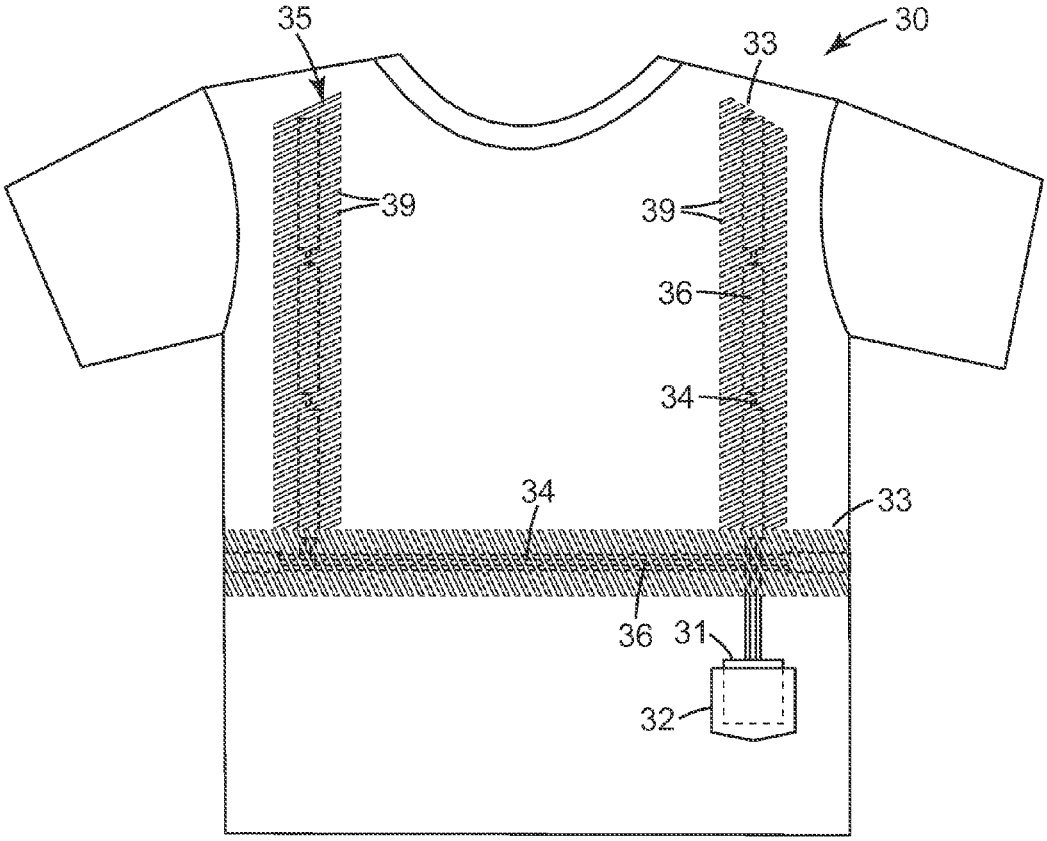
FIG. 3 shows an exemplary reflective and electroluminescent article disposed on a shirt.
Figure 4:
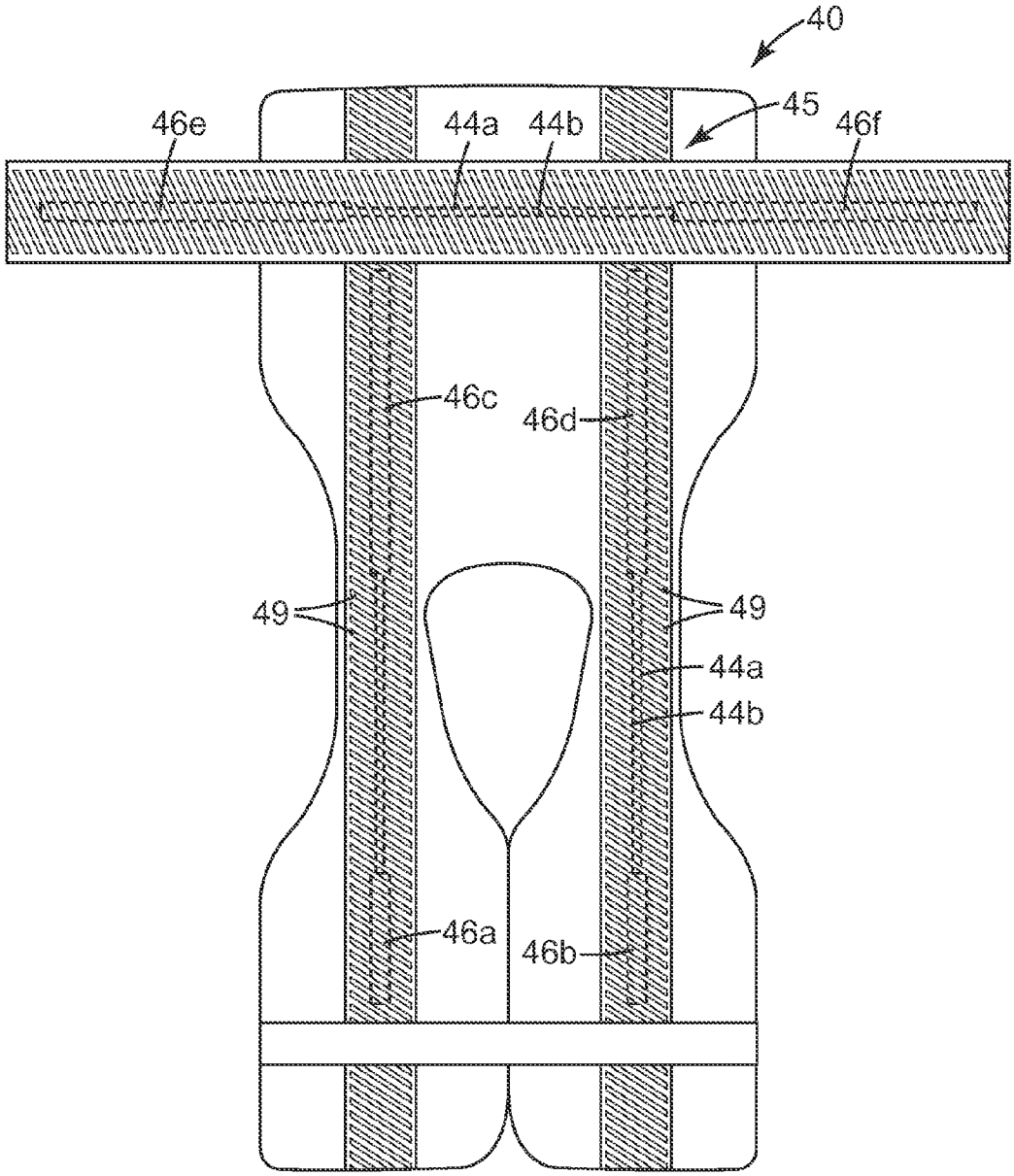
FIG. 4 shows an exemplary reflective and electroluminescent article disposed on a vest.

Retroreflective structures 19 can be disposed relative to electroluminescent structures 16 at least partially in the light path of electroluminescent structures 16, covering an area of an electroluminescent structure that otherwise would be illuminated. For example, one or more retroreflective segments can be arranged as stripes across the electroluminescent structures as shown in FIGS. 2, 3 and 4. One or more retroreflective structures 19 can overlap or intersect with electroluminescent structures 16 in any appropriate configuration so as to be at least partially in the light path of the structures as illustrated in FIG. 1.

Referring further to FIG. 1, retroreflective structure 19 are at least partially in a path of light 15*a* capable of being emitted by the electroluminescent structure 16. For example phosphor layer 166 emits light 15*a*, 15*b*. Because retroreflective segments of the retroreflective structure 19 are disposed in the light path of the electroluminescent article, emitted light 15*a* is blocked while emitted light 15*b* passes between the retroreflective structures and can be visible to a viewer when the article is attached to a power supply.

Figure 6A:
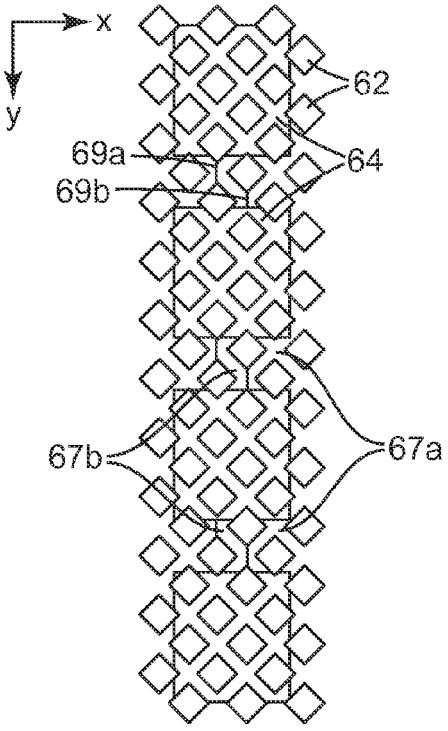
FIG. 6A shows an exemplary configuration of discontinuous electroluminescent structures and discontinuous retroreflective structures configured in a two-dimensional array.
Figure 6B:
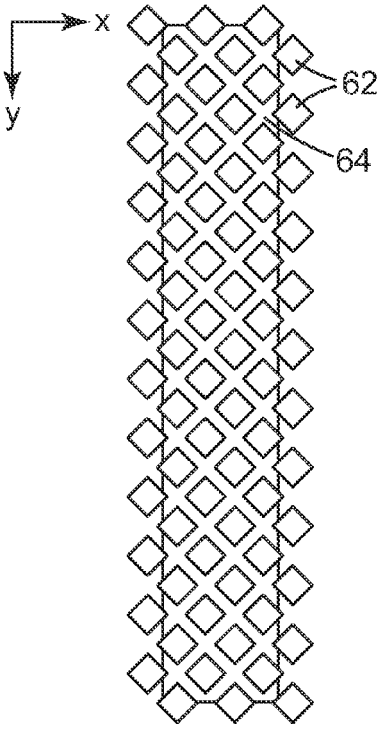
FIG. 6B shows an exemplary configuration of a continuous electroluminescent structure and discontinuous retroreflective structures configured in a two-dimensional array.
Figure 7A:
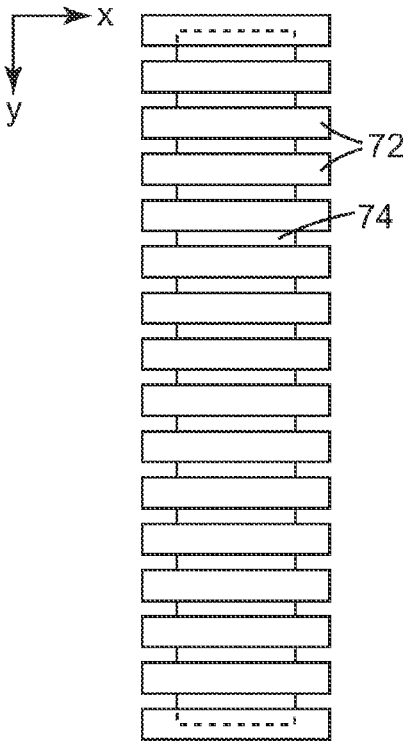
FIG. 7A shows an example of a continuous electroluminescent structure with discontinuous retroreflective structures.
Figure 7B:
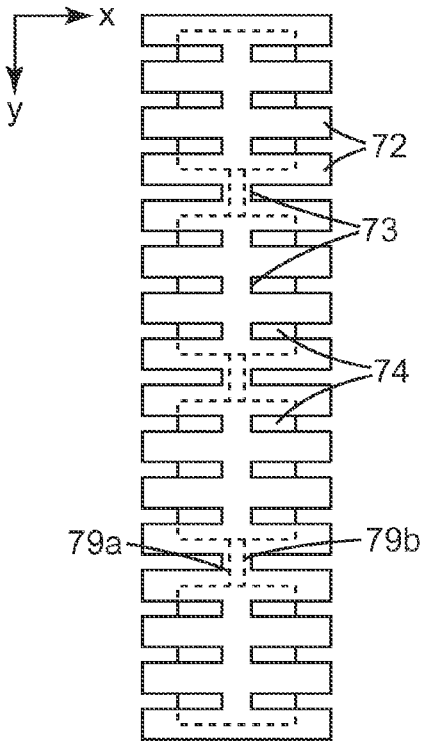
FIG. 7B shows an example of discontinuous electroluminescent structures with a continuous retroreflective structure.

Retroreflective structure 19 can be of a variety of shapes and can be disposed in a variety of patterns. For example, retroreflective structures 12 can be continuous as shown in FIG. 7B or can be discontinuous as shown in FIGS. 5, 6A, 6B and 7A. In some exemplary embodiments, retroreflective structures 19 can include rectangular, parallelograms, square or any other shape segments. Retroreflective structures 19 can be arranged in any configuration including, but not limited to, linear arrays, such as a sequence of parallel stripes shown in FIGS. 2, 3, 4, 5 and 5A, a two dimensional array of generally diamond shapes, as shown in FIGS. 6A and 6B, or parallel bars as shown in FIG. 7A. Electroluminescent structures 16 can also be a variety of shapes depending on intended use and/or other considerations. These shapes and configurations listed above are only examples of the myriad of shapes and arrangements that can be used consistent with the present disclosure. Other shapes and configurations can easily be envisioned by those skilled in the art.

The present disclosure allows to make exemplary garments including laminate reflective and electroluminescent articles 10 that are flexible and, in some cases, at least somewhat stretchable. This is most often the case for at least partially monolithic constructions and constructions including an elastomeric material. For example, exemplary laminate reflective and electroluminescent articles 10 can be capable of being flexed or bent by a user under ordinary usage conditions.

In some embodiments, a laminate electroluminescent and reflective article can be characterized by a drape of no more than 400 g, preferably, no more than 300 g, more preferably, no more than 200 g, even more preferably no more than 100 g, and, most preferably, no more than 85 g. Drape may be measured as described in the Examples section below. The stretchability of an embodiment could be measured in terms of percent elongation prior to break by an Instron™ tensile tester. The Instron™ tensile tester has clamps to hold two ends of a sample, and will exert tensile force, pulling the ends of the sample farther apart until the sample breaks. An article that stretches further per amount of force applied has a lower modulus of elasticity and is generally more stretchable. In some embodiments, a laminate reflective and electroluminescent article can be characterized by a percent elongation of 50 percent or more, more preferably 60 percent or more, even more preferably 70 percent or more, and most preferably, 90 percent or more.

FIG. 2 shows a schematic diagram of an exemplary electroluminescent and retroreflective article 20 that can be disposed on a support on a garment (not shown). As illustrated in FIG. 2, conductors 29*a*, 29*b* can electrically connect a plurality of electroluminescent structures 26 to each other. Conductors 29*a*, 29*b* can also connect electroluminescent structures 26 to a power source 21. Optionally, conductors 29*a*, 29*b* can also connect the electroluminescent structures 26 to any other component, such as an inverter 22. The inverter 22 can convert DC power from the power source 21 to AC power for the electroluminescent structures 26 lamps 26*a*. Alternatively, an AC power source can be used to provide power to the electroluminescent lamps. Additional suitable circuitry and conductors (not pictured) can be included, e.g., to cause the lamps to flash at different rates, provide safety shutoffs for short circuits, or allow for optimized power usage. The inverter 22, where used, and/or power source 21 can be disconnected from the electroluminescent and retroreflective article 20 for battery replacement, washing, or other reasons. In some exemplary embodiments, the inverter can be disposed in the same case as the power source.

In the illustrated embodiment, electroluminescent structures 26 can be discontinuous from each other so that first gaps 27*a* are formed between adjacent electroluminescent structures 26. However, even in this embodiment, electroluminescent structures 26 are still connected by at least two discrete conductors, such as 29*a*, 29*b*, or a bus bar. The conductors 29*a* and 29*b* may be spaced apart from each other to provide second gaps 27*b*. Retroreflective segments 23 can be disposed over and at least partially in the light path of light capable of being emitted by the electroluminescent structures 26. Nonetheless, in the exemplified embodiment, the retroreflective structures do not completely cover the gaps 27*a* between electroluminescent structures 26 and/or the gaps 27*b* between the conductors 29*a* and 29*b*. Thus, when such exemplary laminate articles 20 are disposed on a support (not shown), the gaps 27*a,b* comprise an exposed surface of the support. Having such gaps can be very advantageous, especially if the support is porous, stretchable and/or flexible, because the presence of gaps is believed to improve vapor permeability, stretchability and/or flexibility of the combined laminate article 20 and the support (not shown), as compared to a similar construction without such gaps. Gaps can allow for increased moisture release, which increases perceived comfort of a laminate reflective and electroluminescent article 20 when disposed on a garment. Additionally, gaps can provide more locations for stress relief during wear and wash of a product, thereby increasing product durability and wash resistance.

FIG. 3 shows an exemplary electroluminescent and retroreflective article 35 disposed on a support 33, which forms a part of a garment shell of an as a part of an exemplary garment (here, a shirt). A shirt 30 is only one example of the numerous garments and other articles that an electroluminescent and retroreflective article of the present disclosure could be disposed on or included in. For example, an electroluminescent and retroreflective article could be disposed on a vest, a jacket, pants, gloves, shoes, hats, or any other type of garment. A support can be made of any suitable material, including one or more or fabric, woven material, nonwoven material, rubber, plastic, leather or any other appropriate material. A garment can optionally include a pocket 32 or other means for supporting the power source 31 and/or inverter. A means for supporting power source 31 can be at any suitable location.

An exemplary electroluminescent and retroreflective article 35 disposed on a support 33 can include conductors 34 connecting electroluminescent structures 36 to each other and to a power source 31. Retroreflective structures 39 can be of various shapes and can be configured in any appropriate layout. In the exemplary embodiment illustrated, retroreflective structures 39, such as discontinuous retroreflective segments, are disposed on one or more of front left, front right, back left and back right sides of the garment 30. In one exemplary embodiment, retroreflective structures 39 form right and left sections. The sections may be configured in the form of one or more vertical sections that run up the front and/or down the back of the shirt. Additionally or alternatively, one or more horizontal sections of a retroreflective structure 39, such as discontinuous retroreflective segments, can be disposed about the torso of the garment 30, preferably about a user's waist area. In one exemplary embodiment, retroreflective structures are disposed on at least left and right sides of the garment, extending from the front side to the back side of the garment. As discussed below, discontinuous retroreflective segments 39 can be configured in any suitable or desirable way, for example, to meet the American National Standard for High-Visibility Safety Apparel ("the ANSI Standard") and other similar safety standards as described below.

Electroluminescent structures may follow the same general pattern as the pattern of retroreflective structures on a garment or a different pattern. Referring further to FIG. 3, one or more electroluminescent structures 36 may be disposed on one or more of front left, front right, back left and back right sides of the garment 30. In one exemplary embodiment, electroluminescent structures 36 are disposed generally vertically, for example, extending generally from the waist area toward a shoulder area of the wearer. In some embodiments, electroluminescent structures 36 are disposed on the right and left side of the shirt 30 at least on one of the front and the back sides of the garment 30. Fewer or more electroluminescent structures 36 can be used on a garment consistent with the present disclosure. In some exemplary embodiments, the garment 30 may, additionally or alternatively, include one or more electroluminescent structures 36 disposed generally horizontally on the left and right sides of the garment (extending generally around the torso of a wearer from the front side of the garment to the back side of the garment, in some cases curving about the wearer's body, such as to improve conspicuity of the garment when a wearer's side is turned to an observer).

In other exemplary garments, retroreflective structures and/or electroluminescent structures may be arranged on a garment in any other suitable or desirable configuration. Some examples include a generally X-shaped pattern and a generally chevron-shaped pattern (which resembles a V or an inverted V), which may be disposed on the back and/or on the front of a garment.

An electroluminescent article can be secured to a garment 30 by any appropriate means including, but not limited to, sewing the assembly to the garment, or securing the assembly to the garment with adhesive, such as pressure sensitive adhesive or heat activatable adhesive, or by any other appropriate method.

FIG. 4 shows a vest 40 with an electroluminescent and retroreflective article 45 according to the present disclosure disposed on it. The electroluminescent and retroreflective article includes conductors 44*a*, 44*b*, electroluminescent structures 46*a-f* and a retroreflective structure including retroreflective segments 49. Conductors 44*a*, 44*b*, electroluminescent structures 46*a-f* and retroreflective segments 49 can be made of any material and by any method consistent with the present disclosure or known to individuals of skill in the art. Additionally, the article 45 can be secured to the vest 40 by any method described above or by any other appropriate method. In this exemplary embodiment, electroluminescent structures 46*a* and 46*b* can be disposed on the front portion of the vest 40, right and left sides, respectively. Each of the electroluminescent structures 46*a* and 46*b* can extend from the direction of the waist portion of the vest 40 toward its shoulder portion. Electroluminescent structures 46*c* and 46*d* can be disposed on the back portion of the vest 40, right and left sides, respectively. Each of the electroluminescent structures 46*c* and 46*d* can extend from the direction of the waist portion of the vest 40 toward its shoulder portion. The electroluminescent structures 46*a* and 46*b* can be electrically connected to 46*a* and 46*b*.

The exemplary vest 40 may further include one or more electroluminescent structures 46*e* and 46*f* disposed generally horizontally (extending generally around the torso of a wearer from the front side of the garment to the back side of the garment, in some cases curving about the wearer's body, when the vest 40 is worn). Including such one or more horizontally disposed electroluminescent structures may improve conspicuity of the garment when a wearer's side is turned to an observer. Electroluminescent structures 46*e* and 46*f* can be conveniently provided in or on a waist band/belt.

Figure 5:
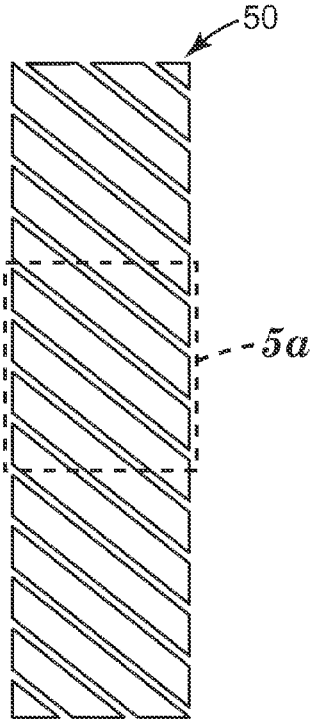
FIG. 5 shows an exemplary pattern of discontinuous retroreflective structures.
Figure 5A:
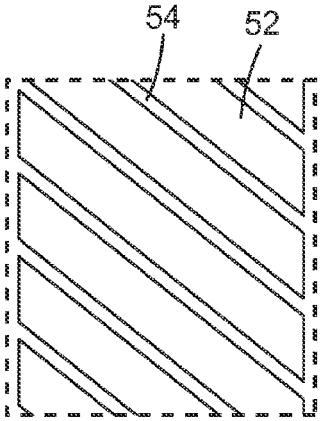
FIG. 5A shows an exemplary pattern of discontinuous retroreflective structures defining retroreflective and non-retroreflective regions.

FIGS. 5 and 5A show an example of a pattern 50 of discontinuous retroreflective structures defining retroreflective 52 and non-retroreflective regions 54, which may be included in an exemplary retroreflective structure according to the present disclosure. In accordance with the present disclosure, the entire area of the non-reflective regions 54 or a portion of the area of the non-reflective regions 54 may be electroluminescent (i.e., emitting light due to electroluminescence of an underlying electroluminescent structure). In some exemplary embodiments, at least portions of at least some of the non-reflective regions 54 comprise gaps in the laminate structure, as explained above. When retroreflective regions 52 are arranged for safety garments, they can be designed to meet various safety standards. One such prominent standard is the ANSI Standard. The ANSI Standard dictates performance requirements for high visibility safety apparel, capable of signaling a user's presence in a conspicuously visible manner under any light conditions by day (this can be accomplished by use of fluorescent color) and under illumination by vehicle headlights in the dark (this can be accomplished by use of retroreflective materials). EN 471 is an example of a similar European standard, and many countries such as Australia, New Zealand, and Canada also have their own standards.

Retroreflective regions 52 can be configured to meet minimum reflectivity requirements. This can be achieved by ensuring that a minimum percentage of the total surface area defined by a pattern 50 (also shown in FIG. 5A) of discontinuous retroreflective segments, here, retroreflective regions 52, sufficient to achieve the appropriate coefficient of retroreflectivity based on the reflective properties of the retroreflective segments. For example, if non-retroreflective regions 54 account for 50 percent of the surface area of a pattern 50 of discontinuous retroreflective segments, the brightness would be approximately 50 percent less than it would be if retroreflective materials were applied in a continuous pattern. In the stripe-like pattern 50 shown in FIG. 5, the retroreflective regions 52 occupy approximately 66 percent of the surface area of pattern 50 and non-retroreflective regions occupy approximately 33 percent of pattern 50. Alternatively, retroreflective regions 52 can occupy at least 50 percent, 75 percent, 85 percent or any other appropriate percentage of a pattern 50 of discontinuous retroreflective segments. The general principle of designing the retroreflective pattern 50 is to maximize the total retroreflectivity of the retroreflective regions 52 while maintaining and maximizing the visibility of light from electroluminescent structures below the discontinuous retroreflective segments that is visible through the non-retroreflective regions 54.

Patterns 50 of discontinuous retroreflective segments consistent with the present disclosure can be designed to meet the ANSI Standard. For example, Table 5 of the ISEA document American National Standard for High-Visibility Safety Apparel (ANSI/ISEA 107-2004) shows a head-on initial minimum required value of 330 $R_a$ (measured in units of candelas per lux per square meter) and a head-on operable minimum required value of 100 $R_a$. In some exemplary embodiments, the electroluminescent and retroreflective article can be characterized by an initial head-on $R_a$ of 330 or more and an operable $R_a$ of 100 or more.

FIGS. 6A and 6B show examples of discontinuous generally diamond-shaped retroreflective structures 62, which may be included in an exemplary retroreflective structure according to the present disclosure. In such exemplary embodiments, the discontinuous retroreflective segments 62 are configured in a two-dimensional array, i.e., two or more discontinuous retroreflective segments are disposed along a first direction X and two or more discontinuous retroreflective segments are disposed along a second direction Y, which is different from the first direction. The first and second directions may be generally orthogonal to each other. Although generally diamond-shaped structures are illustrated, two-dimensional arrays may be formed from retroreflective segments having other shapes and sizes. Electroluminescent structures 64 can be continuous as shown in FIG. 6B or discontinuous as shown in FIG. 6A.

In the embodiment exemplified in FIG. 6A, the retroreflective segments 62 do not completely cover the gaps 67*a* between electroluminescent structures 64 and/or the gaps 67*b* between the conductors 69*a* and 69*b*. Due to the two-dimensional nature of the array of the retroreflective segments 62, in some exemplary embodiments, two or more gaps, 67*a*, 67*b* or a combination thereof, may be disposed along a first direction X. Additionally or alternatively, two or more gaps, 67*a*, 67*b* or a combination thereof, may be disposed along a second direction Y. Some advantages of a laminate article comprising gaps are explained above in connection with FIG. 2. Further advantages to having such gaps in an electroluminescent and retroreflective article including a two-dimensional array of discontinuous retroreflective segments include potential further improvements in vapor permeability, stretchability and/or flexibility of the combined laminate article when it is disposed on a support, such as a thin breathable garment.

FIGS. 7A and 7B show examples of a continuous electroluminescent structure 74 with discontinuous retroreflective structures 72 (FIG. 7A) and discontinuous electroluminescent structures 74 with a continuous retroreflective structure 72, 73 (FIG. 7B). FIG. 7A illustrates a linear array of retroreflective segments 72, in which only one retroreflective segment 72 is disposed along a first direction X, while two or more retroreflective structures are disposed along a second direction Y. FIG. 7B illustrates a continuous retroreflective structure, in which first retroreflective segments 72 are connected by second retroreflective segments 73. Because this exemplary embodiment includes discontinuous electroluminescent structures 74 which must be electrically connected (e.g., by conductors 79*a* and 79*b*), the second retroreflective segments 73 may be advantageously disposed over and cover one or more conductors 79*a*, 79*b*. In such exemplary embodiments, the second retroreflective segments 73 may be used to provide insulation for the conductors and/or protect the conductors from damage.

FIGS. 5-7B are only a few examples of the numerous configurations of electroluminescent structures and retroreflective structures consistent with the present disclosure and are not intended to be limiting in any manner.

EXAMPLES

Historically, the use of electroluminescent lamps has required a stiff, multi-layered construction of electrodes and phosphors along with bulky and stiff crimps and bus bars. When such an assembly is applied to a garment, the garment is somewhat stiff and can be uncomfortable. BeaconWear™ vests made by SAFE LITES™, LLC of Eden Prairie, Minn., ("Traditional Construction") used for comparison with exemplary embodiments of the present disclosure, included traditional electroluminescent lamps extending vertically on the right and left sides of the front and back of the vest. Additionally, traditional electroluminescent lamps extended horizontally around the sides of the vest. A strip of retroreflective materials was attached to the vest to run parallel to each electroluminescent lamp, on each side of the lamp.

One way of characterizing comfort and flexibility of a fabric is to measure its drape. The drape of Traditional Construction was measured using ASTM D6828 test methods. This procedure uses a piece of equipment commonly known as a 'handle-o-meter' to measure the amount of force that is required to bend the sample under test. A stiffer material will require a higher force and a more flexible material (better drape) will require less force. Drape was measured in grams.

Three samples of Traditional Construction were cut from each of two constructions of the lamp and underlying assembly, namely, the vertical and horizontal lamp arrangements. The composition and measured drape of each respective construction is shown in Table 1 below.

Drape for an exemplary embodiment of the current disclosure was also measured. Electroluminescent lamps were made as a monolithic construction such as one disclosed in U.S. Pat. Nos. 5,856,029, 5,856,030, 6,696,786, and 6,717,361. A retroreflective segment pattern similar to that shown in FIG. 6A was formed from Scotchlite™ 8725 series Silver Transfer Film to produce retroreflective segments, which were attached to of the electroluminescent lamps, such that the reflective sides of the retroreflective segments faced away from the electroluminescent lamps. Strips cut from 3M™ CN 3190 Cu/Ni fabric tape were used to electrically connect electroluminescent lamps to each other and to a power source. The assembly was disposed on a fabric substrate and its drape was tested.

TABLE 1

| Comparison of Drape | | | |
|---|---|---|---|
| | Traditional Construction in vertical assembly | Traditional Construction in horizontal assembly | Embodiment of Present Disclosure |
| Construction Components | 1. Typical electroluminescent lamp<br>2. Bus bar<br>3. Ribbon carrier<br>4. Fabric substrate | 1. Typical electroluminescent lamp<br>2. Bus bar<br>3. Fabric substrate | 1. Monolithic lamp<br>2. 3M ™ CN 3190 Cu/Ni fabric tape<br>3. 8725 Silver Transfer Film<br>4. Fabric substrate |
| Sample a | 970 g | 747 g | 87 g |
| Sample b | 970 g | 780 g | 83 g |
| Sample c | 922 g | 812 g | 83 g |
| Average | 954 g | 780 g | 85 g |

One can see that the embodiments of the present disclosure all possessed considerably better drape when compared to either the vertical or horizontal assembly of the Traditional Construction.

A traditional way of measuring the stretchability of a fabric or article is to use an Instron™ tensile tester to exert tensile force on the article until it breaks. An article that stretches further per amount of force applied has a lower modulus of elasticity and is generally more stretchable. A 0.5 inch sample of the Embodiment of the Present Disclosure as described above was tested using an Instron™ tensile tester to determine the percent elongation of each sample prior to breaking

TABLE 2

| Stretchability Measurements | |
|---|---|
| | Embodiment of Present Disclosure |
| Construction Components | 1. Monolithic lamp<br>2. 3M ™ CN 3190 Cu/Ni fabric tape<br>3. 8725 Silver Transfer Film<br>4. Fabric substrate |
| Sample a | 59.71% |
| Sample b | 93.87% |
| Sample c | 58.43% |
| Average | 70.67% |

One can see that embodiments consistent with the present disclosure can have an appreciable elongation indicating stretchability of the exemplary articles.

Positional terms used throughout the disclosure, e.g., over, under, above, etc., are intended to provide relative positional information; however, they are not intended to require adjacent disposition or to be limiting in any other manner. For example, when a layers or structure is said to be "disposed over" another layer or structure, this phrase is not intended to be limiting on the order in which the layers or structures are assembled but simply indicates the relative spatial relationship of the layers or structures being referred to. Furthermore, all numerical limitations shall be deemed to be modified by the term "about."

Although the present disclosure has been described with reference to preferred embodiments, those of skill in the art will recognize that changes made be made in form and detail without departing from the spirit and scope of the present disclosure.

What is claimed is:

1. A garment comprising:

a support and an electroluminescent and retroreflective article disposed on the support wherein the article comprises an electroluminescent structure comprising an electrode layer, a phosphor layer disposed over the electrode layer and a transparent electrode layer disposed over the phosphor layer;

a retroreflective structure disposed over the electroluminescent structure and at least partially in a path of light capable of being emitted by the electroluminescent structure, the retroreflective structure including a plurality of beads and a reflective agent disposed under the beads, the retroreflective structure comprising a plurality of discontinuous retroreflective segments;

wherein a light-emitting side of the electroluminescent structure faces toward the retroreflective structure, and a reflective side of the retroreflective structure faces away from the electroluminescent structure;

wherein at least a portion of the electroluminescent structure is discontinuous, such that at least a portion of the retroreflective structure is disposed over discontinuous segments of the electroluminescent structure;

the article having a head-on initial brightness of at least 330 candela per lux per square meter.

2. The garment of claim 1, wherein a surface of the support is exposed in a gap between at least two discontinuous segments of the electroluminescent structure.

3. The garment of claim 1, wherein at least a portion of the electroluminescent article has a unitary construction.

4. The garment of claim 1, the plurality of discontinuous retroreflective segments are disposed in a linear array.

5. The garment of claim 1, wherein the plurality of discontinuous retroreflective segments is disposed in a two-dimensional array.

6. The article of claim 1, wherein each of the plurality of discontinuous retroreflective segments includes a first pair of generally parallel sides and a second pair of generally parallel sides.

7. The garment of claim 1, wherein the electroluminescent and retroreflective article is stretchable.

8. The garment of claim 1, wherein the electroluminescent and retroreflective article is flexible.

9. The garment of claim 1, wherein the electroluminescent structure comprises an elastomeric material.

10. The garment of claim 1, wherein the plurality of beads is at least partially embedded in a binder layer.

11. The garment of claim 1, further comprising a power source connected to the electroluminescent structure.

12. The garment of claim 1, wherein the support comprises a pocket configured to retain a power source.

13. The garment of claim 1, wherein the electroluminescent and retroreflective article comprises conductive adhesive.

14. The garment of claim 1, wherein the electroluminescent structure and the retroreflective structure form a laminate.

15. The garment of claim 1, wherein the discontinuous segments of the electroluminescent structure are electrically connected in series.

16. The garment of claim 1, further comprising at least one connector that electrically connects at least two of the discontinuous segments of the electroluminescent structure.

17. The garment of claim 1, wherein the retroreflective structure is disposed over the electroluminescent structure and is positioned to block light emitted by the electroluminescent structure.

18. The garment of claim 1, wherein the electroluminescent and retroreflective article has a percent elongation of at least 50%.

19. A garment comprising:

a support and an electroluminescent and retroreflective article disposed on the support wherein the article comprises a plurality of discontinuous electroluminescent structures, each structure comprising an electrode layer, a phosphor layer disposed over the electrode layer and a transparent electrode layer disposed over the phosphor layer;

a retroreflective structure having at least a portion disposed over the plurality of discontinuous electroluminescent structures and at least partially in a path of light capable of being emitted by the plurality of discontinuous electroluminescent structures, the retroreflective structure including a plurality of beads and a reflective agent disposed under the beads, the retroreflective structure comprising a plurality of discontinuous retroreflective segments;

at least one connector, comprising conductive adhesive, wherein the connector electrically connects at least two of the discontinuous electroluminescent structures;

wherein a light-emitting side of the plurality of discontinuous electroluminescent structures faces toward the retroreflective structure, and a reflective side of the retroreflective structure faces away from the plurality of discontinuous electroluminescent structures;

the article having a head-on initial brightness of at least 330 candela per lux per square meter.

20. A method for making a garment comprising:

providing a garment support;

providing a laminate electroluminescent and retroreflective article, the article comprising:

an electroluminescent structure, the electroluminescent structure comprising an electrode layer, a phosphor layer disposed over the electrode layer and a transparent electrode layer disposed over the phosphor layer, a retroreflective structure disposed over the transparent electrode layer, the retroreflective structure including a plurality of beads and a reflective agent disposed under the beads, the retroreflective structure comprising a plurality of discontinuous retroreflective segments, wherein a light-emitting side of the electroluminescent structure faces toward the retroreflective structure and a reflective side of the retroreflective structure faces away from the electroluminescent structure, wherein at least a portion of the electroluminescent structure is discontinuous, such that at least a portion of the retroreflective structure is disposed over discontinuous segments of the electroluminescent structure, and a removable carrier film disposed over the retroreflective structure;

disposing the electroluminescent and retroreflective article on the support such that the removable carrier film faces away from the support; and removing the carrier film from the article, the article having a head-on initial brightness of at least 330 candela per lux per square meter.

21. The method of claim 20, wherein the article further comprises a heat activatable adhesive disposed on a side of the article opposite to the removable carrier film, and the step of disposing comprises heating the article.

22. The method of claim 20, further comprising connecting a power source to the electroluminescent structure.

* * * * *

UNITED STATES PATENT AND TRADEMARK OFFICE

CERTIFICATE OF CORRECTION

PATENT NO. : 9,044,055 B2
APPLICATION NO. : 13/202839
DATED : June 2, 2015
INVENTOR(S) : Rodney Hehenberger It is certified that error appears in the above-identified patent and that said Letters Patent is hereby corrected as shown below:

In the specification

Column 8
Line 16, Delete "26 lamps 26a." and insert -- 26. --, therefor.

In the claims

Column 14
Line 47, In Claim 4, delete "the plurality" and insert -- wherein the plurality --, therefor.
Line 52, In Claim 6, delete "article" and insert -- garment --, therefor.

Signed and Sealed this
Twenty-ninth Day of December, 2015

Michelle K. Lee

Michelle K. Lee
*Director of the United States Patent and Trademark Office*